US011572668B2

(12) United States Patent
Linley

(10) Patent No.: US 11,572,668 B2
(45) Date of Patent: Feb. 7, 2023

(54) MECHANICAL HAMMER

(71) Applicant: Jason Linley, Fort St John (CA)

(72) Inventor: Jason Linley, Fort St John (CA)

( * ) Notice: Subject to any disclaimer, the term of this patent is extended or adjusted under 35 U.S.C. 154(b) by 147 days.

(21) Appl. No.: 17/082,810

(22) Filed: Oct. 28, 2020

(65) Prior Publication Data

US 2021/0123201 A1 Apr. 29, 2021

(30) Foreign Application Priority Data

Oct. 29, 2019 (CA) ..... CA 3060670

(51) Int. Cl.
*E02D 7/06* (2006.01)
*E02D 7/14* (2006.01)
*E02D 7/10* (2006.01)

(52) U.S. Cl.
CPC *E02D 7/10* (2013.01); *E02D 7/14* (2013.01)

(58) Field of Classification Search
CPC ..... E02D 7/00; E02D 7/06; E02D 7/14
USPC ..... 173/114, 216; 405/232
See application file for complete search history.

(56) References Cited

U.S. PATENT DOCUMENTS

| | | | | |
|---|---|---|---|---|
| 2,952,132 | A * | 9/1960 | Urban | E02D 1/022 74/32 |
| 6,749,371 | B2 | 6/2004 | Jones | |
| 7,387,173 | B2 | 6/2008 | Jinnings et al. | |
| 9,328,477 | B2 | 5/2016 | Goodbourn et al. | |
| 2003/0077127 | A1 | 4/2003 | Jones | |
| 2014/0193209 | A1 | 7/2014 | Goodbourn et al. | |

FOREIGN PATENT DOCUMENTS

| | | | |
|---|---|---|---|
| CN | 108035350 | A * | 5/2018 |
| CN | 109577328 | A * | 4/2019 |
| JP | 2003206531 | A * | 7/2003 |
| JP | 2002047878 | A * | 2/2015 |

* cited by examiner

*Primary Examiner* — Sunil Singh
(74) *Attorney, Agent, or Firm* — Finch & Maloney PLLC

(57) ABSTRACT

A mechanical hammer that includes a support and an elongated member. The support defines a linear guide track. The elongated member is laterally confined by the support while being movable back and forth along the linear guide track between an extended position extending from the support and a retracted position relatively retracted within the support. A rack and pinion drive assembly is provided to selectively drive the elongated member along the linear guide track.

6 Claims, 4 Drawing Sheets

MECHANICAL HAMMER

FIELD

There is described a mechanical hammer that was developed to drive posts and piles, but which has other uses.

BACKGROUND

U.S. Pat. No. 7,387,173 (Jinnings et al) titled "pile driver" is an example of a mechanical hammer.

SUMMARY

There is provided a mechanical hammer that includes a support and an elongated member. The support defines a linear guide track. A support mounting assembly is provided on the support for mounting the support. For example, the support may be mounted to an articulating boom that is capable of positioning the mechanical hammer in preparation for use. The elongated member is laterally confined by the support while being movable back and forth along the linear guide track between an extended position extending from the support and a retracted position relatively retracted within the support. A rack and pinion drive assembly is provided to selectively drive the elongated member along the linear guide track. The drive assembly includes two toothed racks mounted on opposed sides of the elongated member and extending lengthwise along the elongated member in parallel spaced relation. Two pinion gears are rotatably mounted to the support. Each of the two pinion gears engage one of the two toothed racks. Two drive motors selectively impart rotation to the pinion gears, with the pinion gears engaging the toothed racks to move the elongated member along the linear guide track.

Two embodiments of the mechanical hammer will hereinafter be illustrated and described. A first embodiment has the two unidirectional drive motors rotate the pinion gears which engage the toothed racks to lift the elongated member to the retracted position, when the two unidirectional drive motors are deactivated, the elongated member falls by force of gravity to the extended position. A second embodiment has four unidirectional drive motors. When when activated a first pair of the four unidirectional drive motors rotate the pinion gears which engage the toothed racks to move the elongated member to the retracted position, while a second pair of the four unidirectional drive motors are deactivated and rotate freely. When activated the second pair of the four unidirectional drive motors rotate the pinion gears which engage the toothed racks to drive the elongated member to the extended position, while the first pair of the four unidirectional drive motors are deactivated and rotate freely.

It is advantageous to provide an attachment mounting assembly at the first end of the elongated member. This enables additional mass attachments to be mounted to the attachment mounting assembly for the purpose of increasing the mass of the elongated member.

An advantage of these embodiments is the low profile of the mechanical hammer for use where there is relatively little clearance. The second embodiment provides an additional advantage as the drive motors increase the impact energy by driving the elongated member to the extended position when in a vertical orientation. Further, the second embodiment can be used in a horizontal or angular orientation as gravity is not required for activation.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
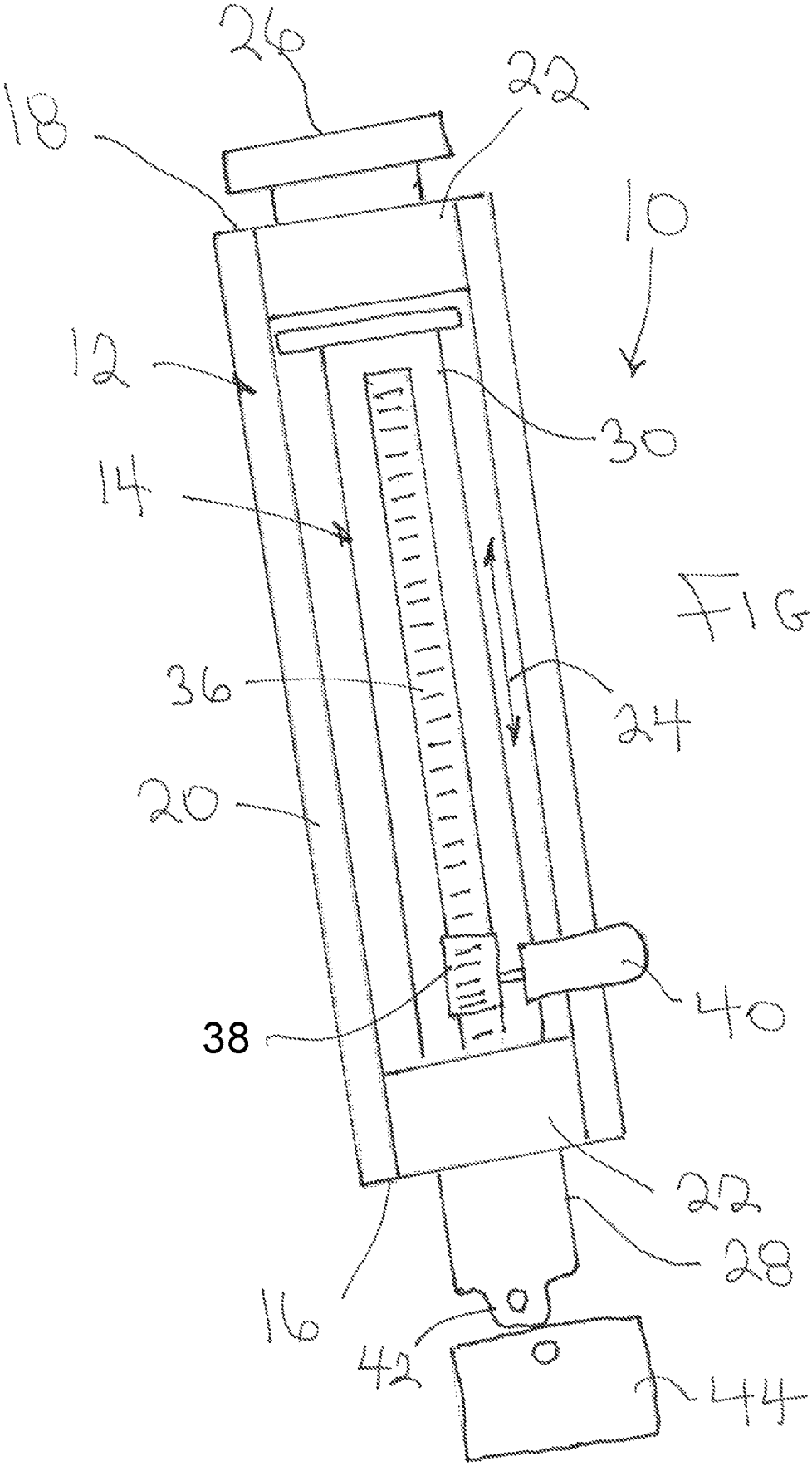
FIG. 1 is a side elevation view of a mechanical hammer, in a retracted position.

A mechanical hammer generally identified by reference numeral 10, will now be described with reference to FIG. 1 through FIG. 4.

Figure 2:
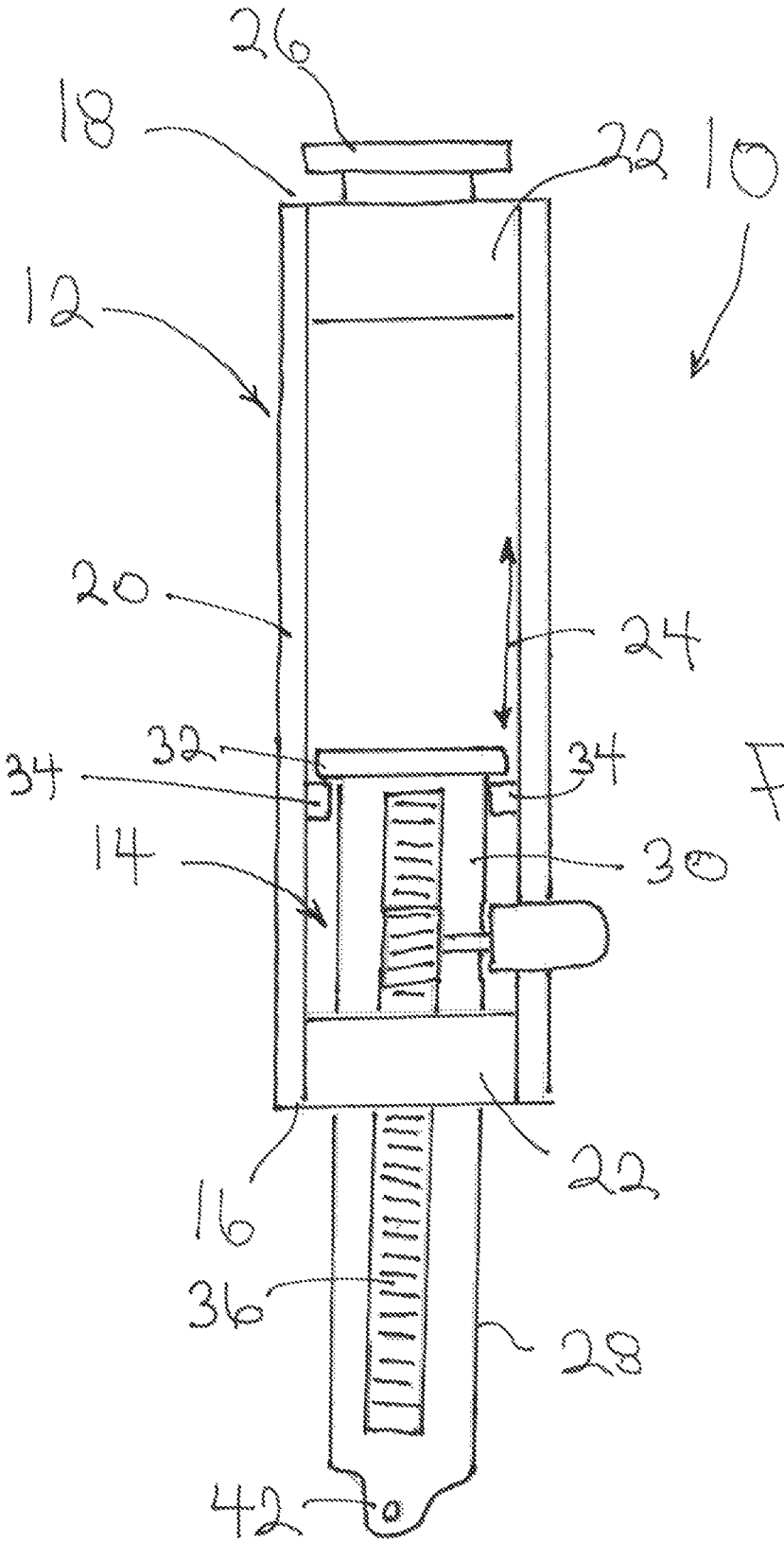
FIG. 2 is a side elevation view of the mechanical hammer of FIG. 1, in an extended position.
Figure 3:
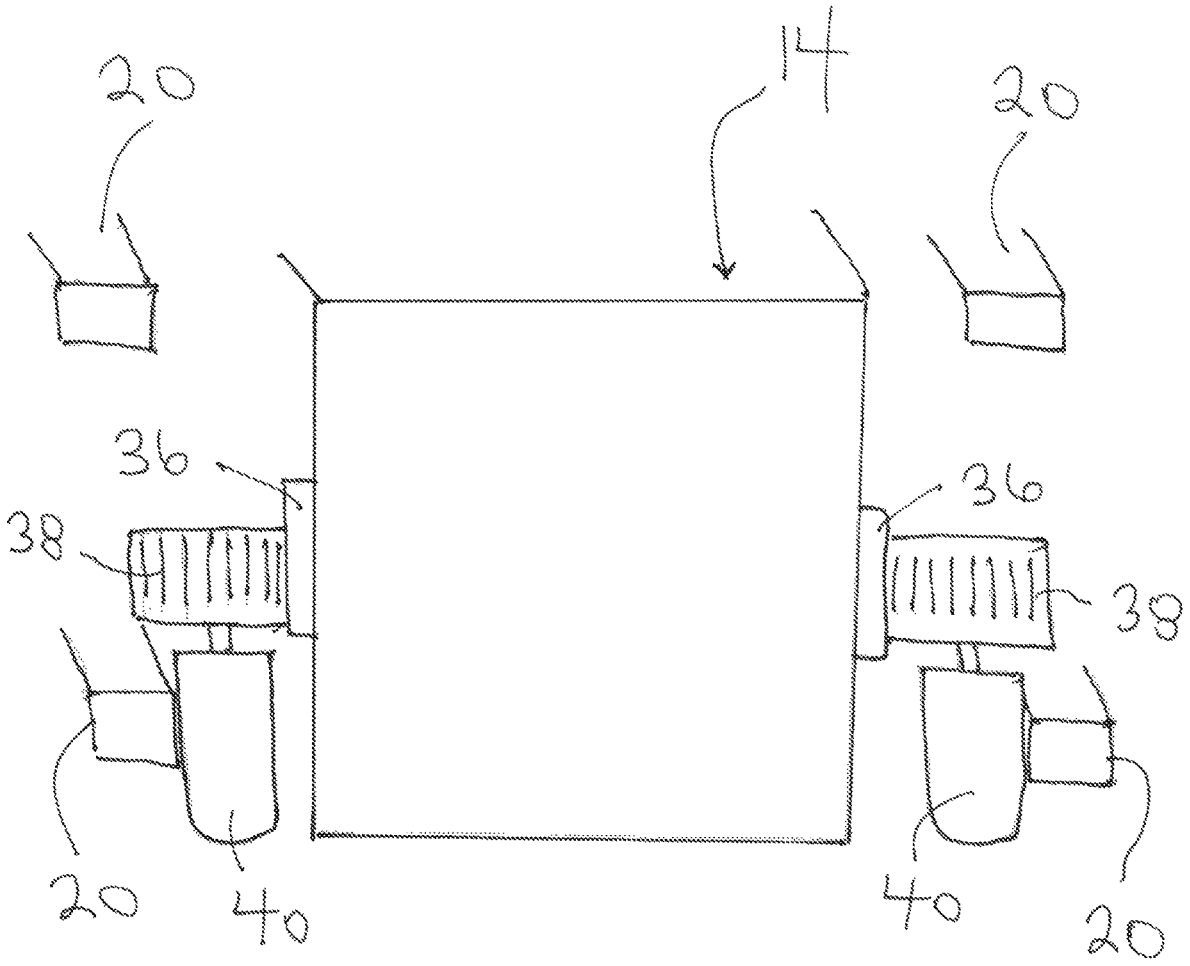
FIG. 3 is an end elevation view, in section, of a first embodiment which is a gravity impact version of the mechanical hammer of FIG. 1.

Structure and Relationship of Parts:

Referring to FIG. 1 and FIG. 2, mechanical hammer 10 includes a support, generally indicated by reference numeral 12 and an elongated member 14. Support 12 has a first end 16 and a second end 18. When in a vertical orientation first end 16 would be considered to be a lower end and second end 18 would be considered to be an upper end. Support 12 is in the form of a frame having has longitudinal members 20 with box form connective members 22 at first end 16 and second end 18 connecting the four longitudinal members 20. Referring to FIG. 3, there are four longitudinal members 20. Referring to FIG. 1 and FIG. 2, support 12 defines a linear guide track, generally indicated by arrow 24. A support mounting assembly, generally indicated by reference numeral 26, is provided at second end 18 of support 12. Support mounting assembly 26 is used to mount support 12 to an articulating boom (not shown) that is capable of positioning mechanical hammer 10 in preparation for use.

Referring to FIG. 1 and FIG. 2, elongated member 14 has a first end 28 and a second end 30. When in a vertical orientation, first end 28 would be considered to be a lower end and second end 30 would be considered to be an upper end. Elongated member 14 is laterally confined by support 12 while being movable back and forth along linear guide track 24 between an extended position extending from support 12, as illustrated in FIG. 2 and a retracted position relatively retracted within support 12, as illustrated in FIG. 1. Referring to FIG. 2, a first stop 32 is positioned at second end 30 of elongated member 14 and a second stop 34 is mounted to support 12. First stop 32 engages second stop 34 to limit movement in the extended position of elongated member 14 along linear guide track 24.

Figure 4:
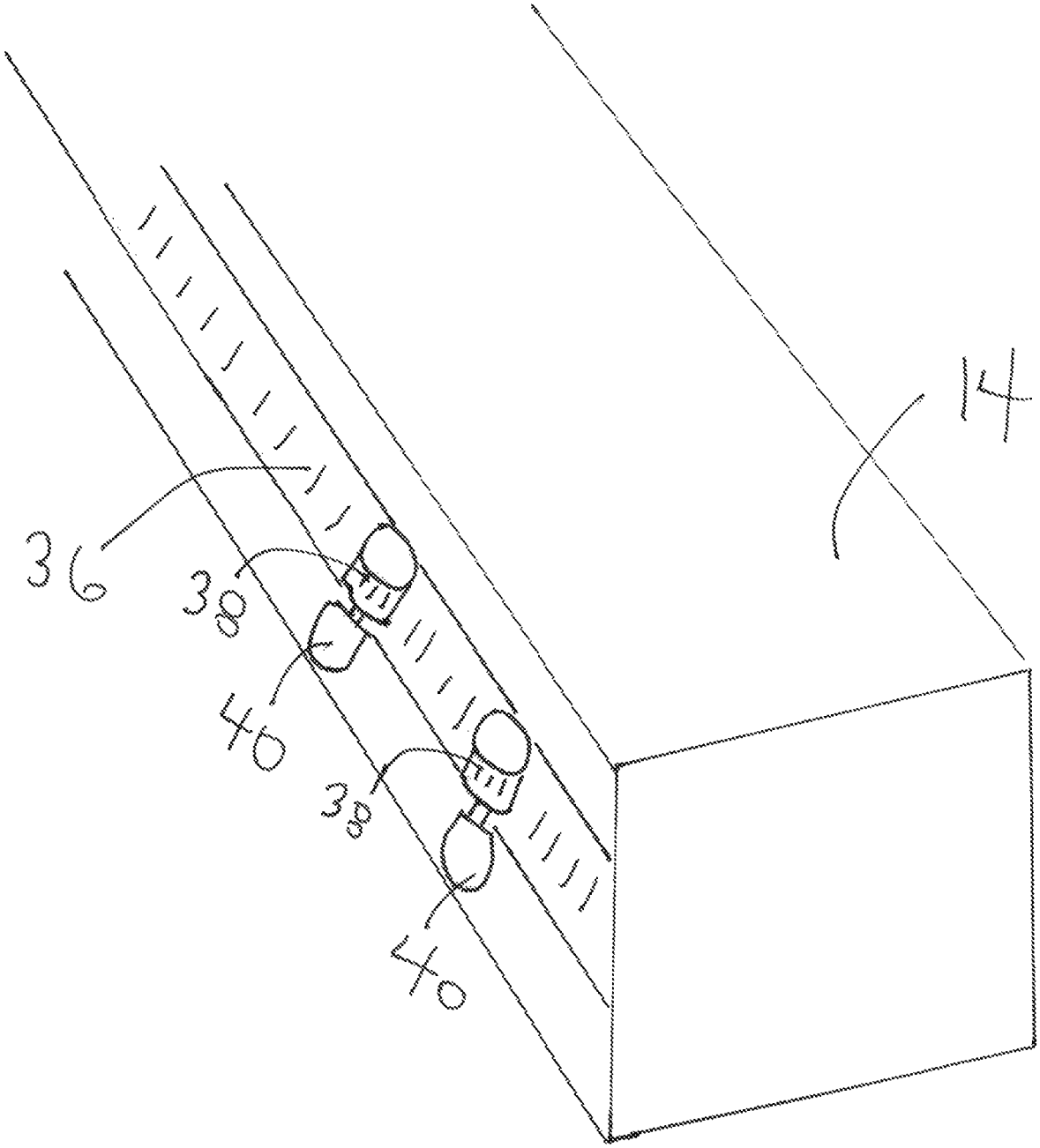
FIG. 4 is a perspective view, in section, of a second embodiment which is a motor driven impact version of the mechanical hammer of FIG. 1.

Referring to FIG. 1 and FIG. 2, a rack and pinion drive assembly is provided to selectively drive elongated member 14 along linear guide track 24. Referring to FIG. 3, the drive assembly includes two toothed racks 36 mounted on opposed sides of elongated member 14. Referring to FIG. 1 and FIG. 2, toothed racks 36 extend lengthwise along elongated member 14. Referring to FIG. 3, toothed racks 36 are in parallel spaced relation. Two pinion gears 38 are rotatably mounted to support 12. Each of pinion gears 38 engage one of two toothed racks 36. Two drive motors 40 selectively impart rotation to pinion gears 38, with pinion gears 38 engaging toothed racks 36 to move elongated member 14 along linear guide track 24 between the retracted position illustrated in FIG. 1 and the extended position illustrated in FIG. 2. Referring to FIG. 4, there are a total of four drive motors 40, with two drive motors 40 positioned on each side of elongated member 14.

Operation:

Elongated member 14 of mechanical hammer 10 moves from the retracted position illustrated in FIG. 1, to the extended position illustrated in FIG. 2. When in the extended position, elongated member 14 delivers an impact.

There are two embodiments, the drive motors 40 for a first embodiment which is a gravity impact version of mechanical hammer 10 are illustrated in FIG. 3 and the drive motors 40 for a second embodiment which is a motor driven impact version of mechanical hammer 10 are illustrated in FIG. 4.

While various type of drive motors 40 may be used with the invention, in developing the proto-type, hydraulic motors were used. When hydraulic fluid is pumped by a pump from a hydraulic reservoir, the system becomes pressurized and drive motors 40 rotate in one direction. When drive motors 40 are deactivated, by shutting off the pump, drive motors 40 rotate frees in the opposite direction in response to a force with hydraulic fluid flowing back to the hydraulic reservoir.

Referring to FIG. 3, the gravity impact version of mechanical hammer 10 has two unidirectional drive motors 40 which rotate pinion gears 38 which engage toothed racks 36 on each side of elongated member 14 to lift elongated member to the retracted position illustrated in FIG. 1. When these two unidirectional drive motors 40 are deactivated, elongated member 14 falls by force of gravity to the extended position illustrated in FIG. 2.

Referring to FIG. 4, the motor driven impact version of mechanical hammer 10 has four unidirectional drive motors 40. When activated, a first pair of the four unidirectional drive motors 40 rotate pinion gears 38 which engage toothed racks 36 on either side of elongated member 14 to move elongated member 14 to the retracted position. In this aspect, it functions exactly as the gravity impact version of mechanical hammer 10, illustrated in FIG. 3. However, there is a second pair of the four unidirectional drive motors 40, this second pair of drive motors 40 are deactivated and rotate freely, when the first pair are functioning.

When activated, the second pair of the four unidirectional drive motors 40 rotate pinion gears 38 which engage toothed racks 36 on either side of elongated member 14 to drive elongated member 14 to the extended position, illustrated in FIG. 2. The first pair of the four unidirectional drive motors 40 are deactivated and rotate freely, when the second pair are functioning.

Advantages:

An advantage common to both the first embodiment with unidirectional drive motors and the second embodiment with bidirectional drive motors is the low profile of mechanical hammer 10. This allows mechanical hammer 10 to be used where there is relatively little clearance.

An additional advantage of the second embodiment is that drive motors 40 increase the impact energy by driving the elongated member to the extended position when in a vertical orientation.

A further advantage of the second embodiment is that they facilitate mechanical hammer 10 being used in a horizontal or angular orientation, as gravity is not required for activation.

The hammer can be attached to a crane, excavator, mast and or a drill carrier for use in horizontal or vertical applications.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. A mechanical hammer, comprising:

a support defining a linear guide track;

a support mounting assembly on the support for mounting the support;

an elongated member that is laterally confined by the support while being movable back and forth along the linear guide track between an extended position extending from the support and a retracted position relatively retracted within the support, the elongated member having a first end and a second end;

a rack and pinion drive assembly that selectively drives the elongated member along the linear guide track, the rack and pinion drive assembly comprising:

toothed racks mounted on opposed sides of the elongated member and extending lengthwise along the elongated member in parallel spaced relation;

two pinion gears rotatably mounted to the support, each of the two pinion gears engaging one of the toothed racks;

two unidirectional drive motors to selectively impart rotation to the two pinion gears respectively, with the two pinion gears engaging the toothed racks to drive the elongated member along the linear guide track; and wherein when activated, the two unidirectional drive motors rotate the two pinion gears which engage the toothed racks to lift the elongated member to the retracted position, and wherein when the two unidirectional drive motors are deactivated, the elongated member falls by force of gravity to the extended position.

2. The mechanical hammer of claim 1, further comprising two additional unidirectional drive motors, when activated a first pair of the four unidirectional drive motors rotate the pinion gears which engage the toothed racks to move the elongated member to the retracted position, while a second pair of the four unidirectional drive motors are deactivated and rotate freely, when activated the second pair of the four unidirectional drive motors rotate the pinion gears which engage the toothed racks to drive the elongated member to the extended position, while the first pair of the four unidirectional drive motors are deactivated and rotate freely.

3. The mechanical hammer of claim 1, further comprising an attachment mounting assembly positioned at the first end of the elongated member, whereby attachments are mounted to the elongated member.

4. The mechanical hammer of claim 3, wherein additional mass attachments are provided for mounting to the attachment mounting assembly to increase the mass of the elongated member.

5. The mechanical hammer of claim 1, wherein a first stop is positioned at the second end of the elongated member and a second stop is mounted to the support, the first stop engaging the second stop to limit movement in the extended position of the elongated member along the linear guide track.

6. The mechanical hammer of claim 1, wherein the drive motors are hydraulic motors.

* * * * *